US006845866B2

(12) United States Patent
Zieger

(10) Patent No.: US 6,845,866 B2
(45) Date of Patent: Jan. 25, 2005

(54) DISPENSER

(76) Inventor: N. Henning Zieger, 925 S. Los Robles Ave., Pasadena, CA (US) 91106

( * ) Notice: Subject to any disclaimer, the term of this patent is extended or adjusted under 35 U.S.C. 154(b) by 93 days.

(21) Appl. No.: 10/269,779

(22) Filed: Oct. 10, 2002

(65) Prior Publication Data

US 2004/0069666 A1 Apr. 15, 2004

(51) Int. Cl.[7] ..... B65D 83/10

(52) U.S. Cl. ..... 206/355; 53/410; 206/360; 206/459.1; 221/8

(58) Field of Search ..... 53/410; 40/109, 40/122, 362, 375, 657; 211/59.3; 221/2, 6–8, 4, 5; 30/40.2; 206/352–360, 459.1

(56) References Cited

U.S. PATENT DOCUMENTS

| | | | | | |
|---|---|---|---|---|---|
| 2,735,553 | A | * | 2/1956 | Lehman | 211/59.3 |
| 3,696,915 | A | * | 10/1972 | Douglas | 206/356 |
| 3,880,284 | A | * | 4/1975 | Pomfret | 206/354 |
| 4,034,892 | A | | 7/1977 | Braginetz | |
| RE29,571 | E | * | 3/1978 | Dawidowicz et al. | 30/40.2 |
| D249,637 | S | | 9/1978 | Iten | |
| 4,114,780 | A | | 9/1978 | Sharon | |
| 4,140,244 | A | | 2/1979 | Clabby | |
| 4,173,285 | A | | 11/1979 | Kiraly | |
| D256,995 | S | | 9/1980 | Kiraly | |
| D256,997 | S | | 9/1980 | Motta | |
| D256,998 | S | | 9/1980 | Motta | |
| 4,285,428 | A | | 8/1981 | Beddall | |
| 4,450,980 | A | | 5/1984 | Clabby | |
| 4,972,968 | A | | 11/1990 | Iten | |
| 4,978,031 | A | | 12/1990 | Lembke | |
| 5,409,133 | A | | 4/1995 | Gringer | |
| D366,611 | S | | 1/1996 | Poisson | |
| D397,290 | S | | 8/1998 | Petricca | |
| D398,522 | S | | 9/1998 | Petricca | |
| D398,523 | S | | 9/1998 | Petricca | |
| 5,867,907 | A | * | 2/1999 | Terry et al. | 30/40.2 |
| 5,946,805 | A | * | 9/1999 | Oldroyd | 30/40.2 |
| D430,013 | S | | 8/2000 | Shurtleff | |

* cited by examiner

*Primary Examiner*—Jim Foster
(74) *Attorney, Agent, or Firm*—Henricks, Slavin & Holmes LLP

(57) ABSTRACT

A dispenser for storing and dispensing a plurality of objects including a tray defining a storage area and a divider assembly located within the storage area.

4 Claims, 7 Drawing Sheets

DISPENSER

BACKGROUND OF THE INVENTIONS

1. Field of Inventions

The present inventions relate generally to dispensers that store and dispense objects such as, for example, razor blade cartridge dispensers.

2. Description of the Related Art

There are many instances where objects are stored and dispensed. Frequently, objects are stored in dispensers that can also receive and store the dispensed objects after they have been used. Although the present inventions are not limited to any particular types of objects, razor blade cartridges are one example of objects that are frequently stored and dispensed and, in some instances, stored again after they have been used.

The inventor herein has determined that there are a number of problems associated with conventional dispensers. In the context of razor blade cartridges, for example, some conventional razor blade cartridge dispensers allow the user to remove and replace any one of the razor blade cartridges being stored at any given time. This situation can result in used and unused razor blade cartridges being interspersed with one another, thereby requiring the user to closely examine each cartridge when attempting to withdraw an unused cartridge from the dispenser, as well as making it difficult to determine exactly how many unused cartridges remain. This situation can also lead people to simply deposit the used cartridges into trash containers, as opposed to returning them to dispensers for disposal, which is unsafe.

SUMMARY OF THE INVENTIONS

A dispenser in accordance with one embodiment of a present invention includes a tray defining a storage area having an inlet and an outlet and a movable divider assembly located within the storage area. Such a dispenser may be used in conjunction with, for example, razor blade cartridges and other dispensable objects and there are a number of advantages associated with the dispenser. For example, unused objects may be removed from the dispenser by way of the outlet and used objects may be returned to the dispenser by way of the inlet. This prevents users from obtaining a previously used object. Additionally, the divider assembly may be positioned within the storage area such that it separates the used and unused objects, thereby making it easy for the user to determine how many unused objects are present in the dispenser at any given time.

The above described and many other features and attendant advantages of the present inventions will become apparent as the inventions become better understood by reference to the following detailed description when considered in conjunction with the accompanying drawings.

BRIEF DESCRIPTION OF THE DRAWINGS

Detailed description of preferred embodiments of the inventions will be made with reference to the accompanying drawings.

DETAILED DESCRIPTION OF THE PREFERRED EMBODIMENTS

Figure 1:
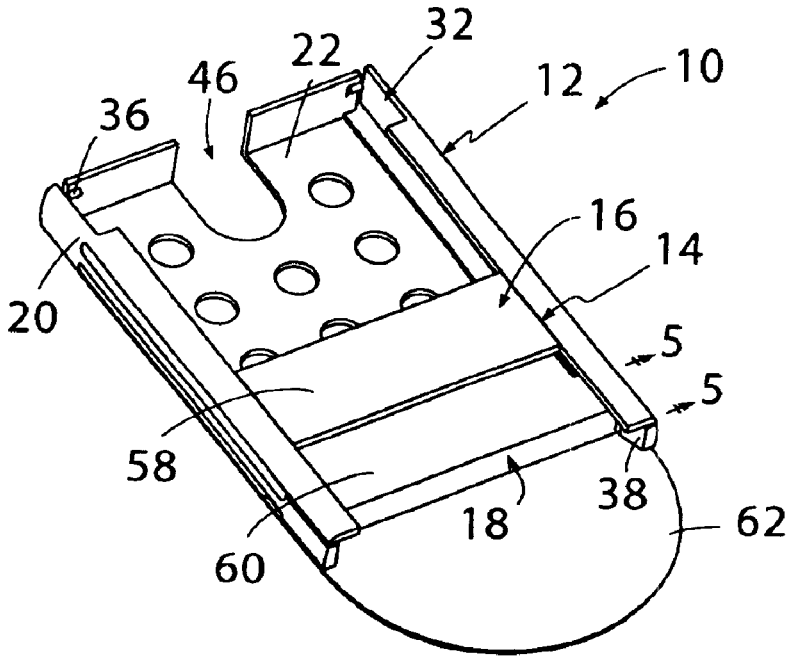
FIG. 1 is a perspective view of a dispenser in accordance with a preferred embodiment of a present invention.
Figure 2:
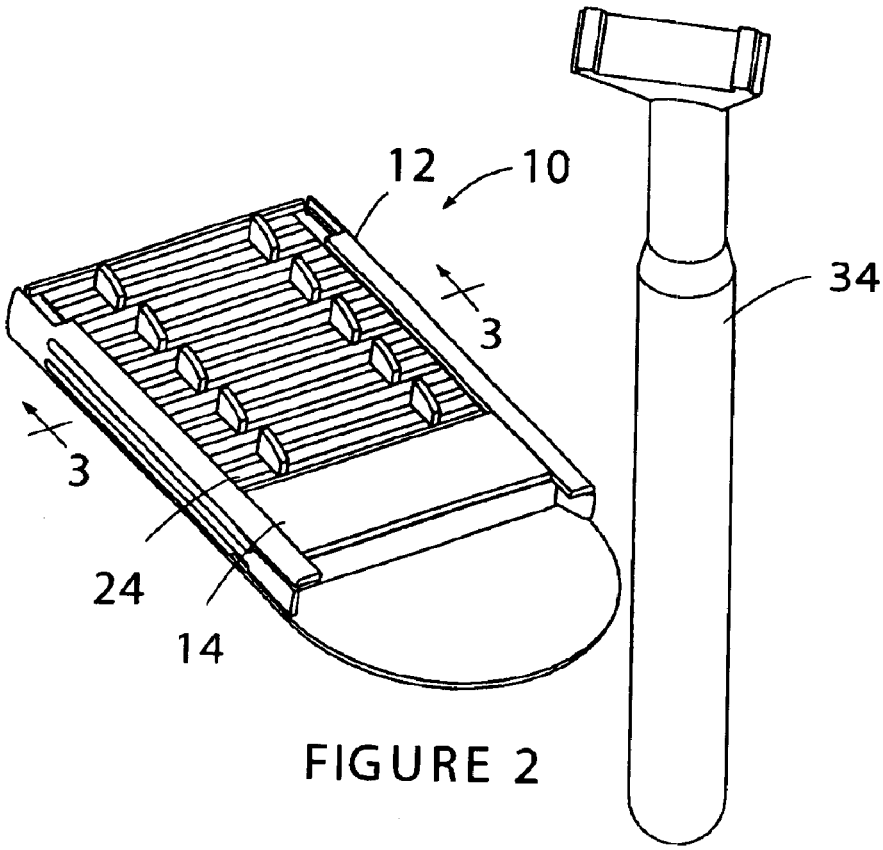
FIG. 2 is a perspective view of the dispenser illustrated in FIG. 1 filled with a plurality of unused objects.
Figure 3:
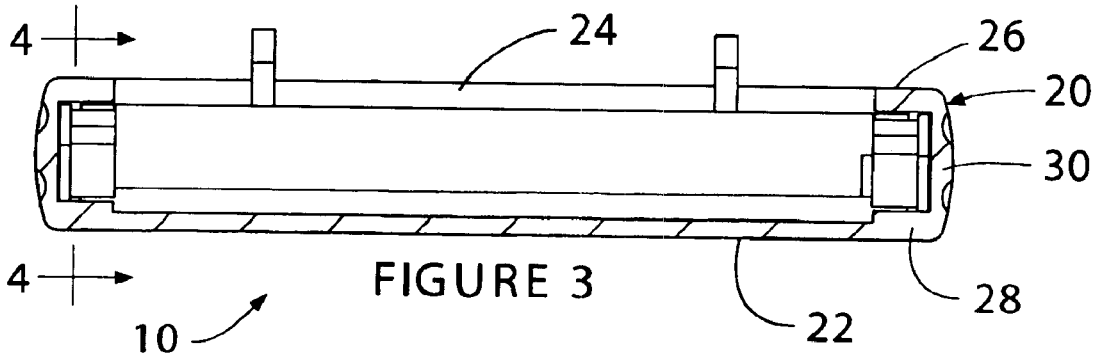
FIG. 3 is section view taken along line 3—3 in FIG. 2.
Figure 4:
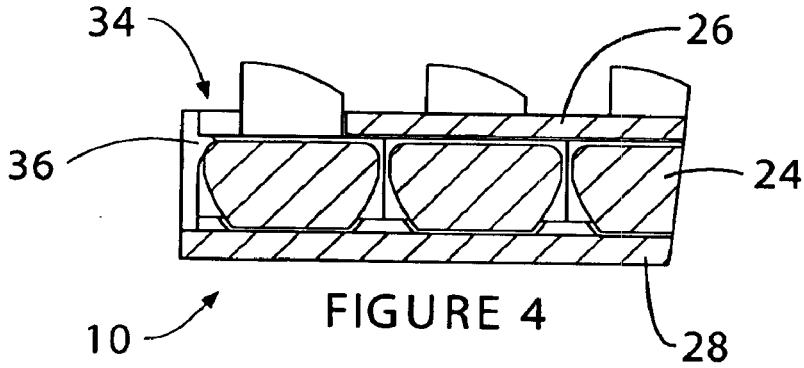
FIG. 4 is section view taken along line 4—4 in FIG. 3.

The following is a detailed description of the best presently known modes of carrying out the inventions. This description is not to be taken in a limiting sense, but is made merely for the purpose of illustrating the general principles of the inventions. Additionally, although the inventions herein are discussed in the context of razor blade cartridges, the storage and dispensing mechanisms described herein are not limited solely to use with razor blade cartridges. Thus, although various exemplary storage and dispensing mechanisms are described below with reference to razor blade cartridges, other types of dispensable objects, such as disposable craft-knife blades, surgical blades, cutting tools (e.g. end mills and drill bits) and syringes, are equally applicable to the present inventions. It should also be noted that detailed discussions of razor blade cartridges, as well as the handles that support them during shaving, which are not pertinent to the present inventions have been omitted for the sake of simplicity.

As illustrated for example in FIGS. 1–5, a dispenser 10 in accordance with a preferred embodiment of a present invention includes a tray 12 and a divider assembly 14 that has a top divider 16 and a bottom divider 18. A biasing device (described below with reference to FIGS. 6 and 7) biases the divider assembly 14 to the expanded state illustrated in FIG. 1. The biasing device also allows the divider assembly 14 to be compressed into the compressed state illustrated in FIG. 2. The tray 12 includes a storage area which, in the illustrated embodiment, is defined by a pair of retaining elements 20 that are carried at the lateral edges of a bottom wall 22. The retaining elements 20 in the exemplary implementation are substantially c-shaped in cross-section and are configured (i.e. sized and shaped) to hold a plurality of razor blade cartridges 24. More specifically, the retaining elements 20 include top, bottom and side walls 26, 28 and 30 (note FIGS. 3 and 4) that limit the movement of the razor blade cartridges 24 such that the only substantial movement of the cartridges along the longitudinal axis of the tray 12.

Figure 5:
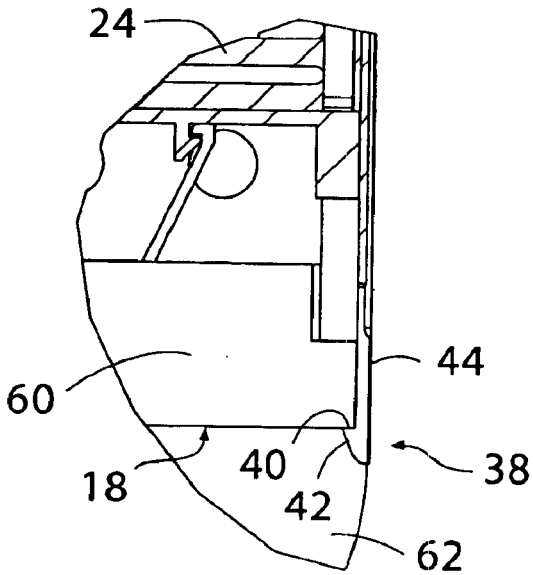
FIG. 5 is a section view taken along line 5—5 in FIG. 1.
Figure 8:
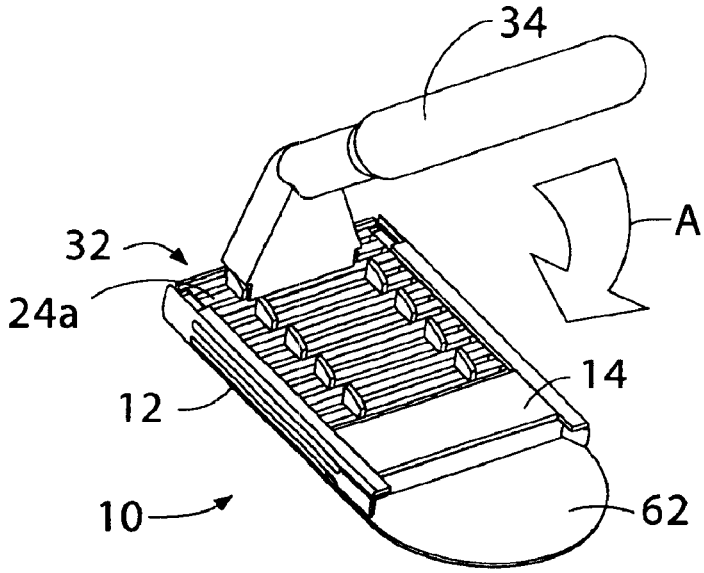
FIG. 8 is a perspective view of the dispenser illustrated in FIG. 1 showing the first object being removed.
Figure 9:
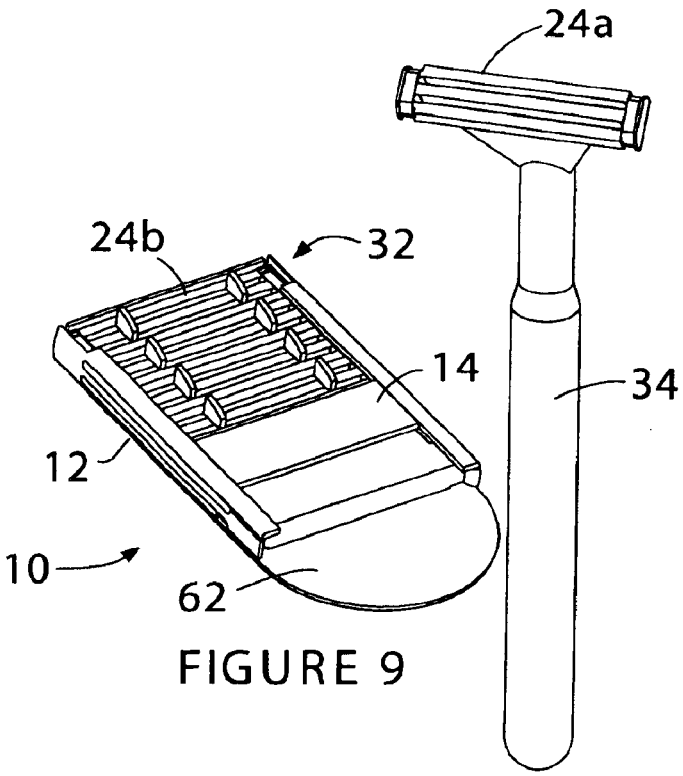
FIG. 9 is a perspective view of the dispenser illustrated in FIG. 1 with the first object removed.
Figure 10:
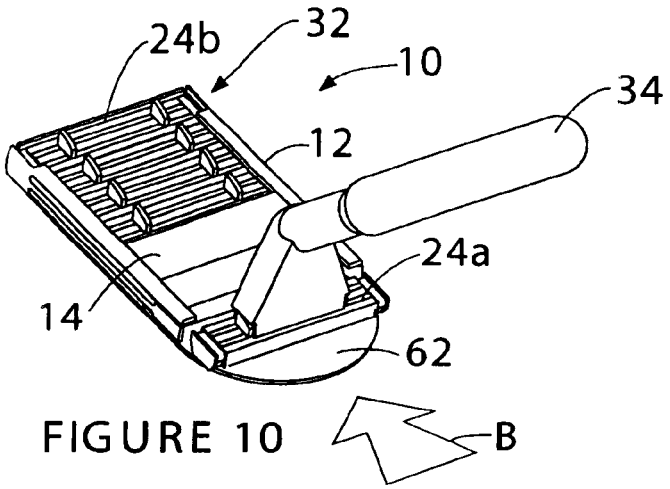
FIG. 10 is a perspective view of the dispenser illustrated in FIG. 1 showing the first object being returned to the dispenser.

The retaining elements 20 in the exemplary implementation also include an open region 32 through which the razor blade cartridges 24 can be removed from the dispenser 10 using the leverage and pivoting motion of a razor handle 34 in the manner described below with reference to FIGS. 8 and 9. A pair of retaining devices 36, which are located at the same end of the tray 12 as the open region 32, engage the leading razor blade cartridge 24 (or other dispensed object) to keep the cartridge in place until removal is desired. A pair of tension latches 38 prevent the razor blade cartridges 24 from emerging from the other end of the tray 12. The tension latches 38 are "one-way latches" in that they also allow used razor blade cartridges 24 to be reinserted into the tray 12 in the manner described below with reference to FIG. 10. Referring more specifically to FIG. 5, the tension latches 38 include an engaging surface 40 that engages either a razor blade cartridge 24 or the divider assembly 14 (depending on whether or not cartridges have been used and returned), a cam surface 42 and a flexible arm 44 that deflects when the cam surface is engaged. This tension latch configuration also precludes the removal of cartridges therethrough during normal operations.

The exemplary tray 12 may also be provided with a slot 46 (FIG. 1) so that a removing force may be applied to the razor blade cartridge 24 (or other dispensed object) that is aligned with the open region 32 in those instances where a handle is not used to free the object. Such removing force may be applied by, for example, a person's finger or robotic arm in an automated system.

As noted above, the divider assembly 14 is biased to the expanded state illustrated in FIG. 1. Such biasing urges the leading unused razor blade cartridge 24 toward the open region 32 when the exemplary dispenser 10 is full (FIG. 2) and the divider assembly 14 is compressed. In addition, after a razor blade cartridge 24 has been removed from the dispenser (FIG. 9), the expanded biasing assembly will fill the resulting gap as it biases the next unused cartridge toward the open region 32. The divider assembly will continue to function in this manner when used razor blade cartridges 24 are returned to the dispenser in the manner discussed below with reference to FIGS. 10–12.

Figure 6:
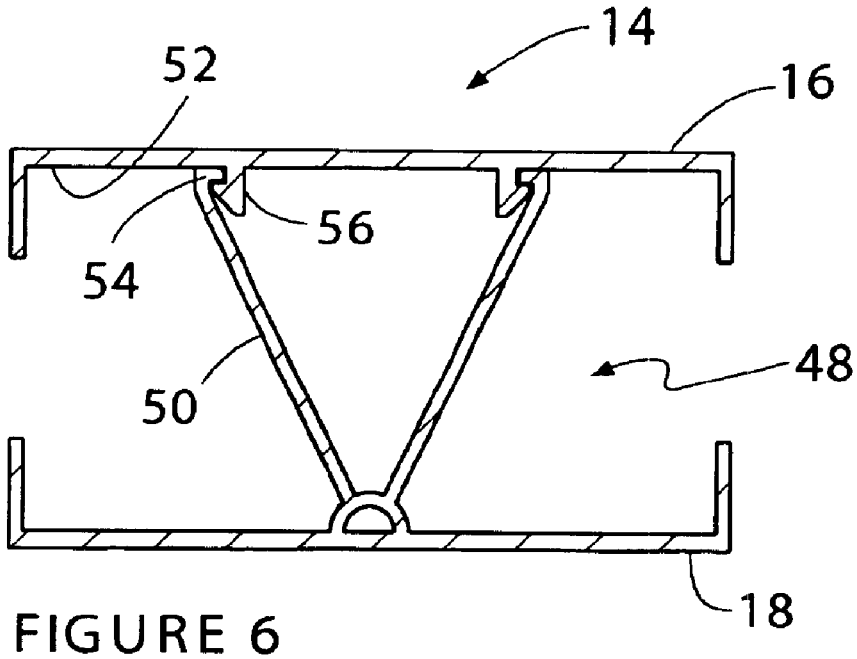
FIG. 6 is a section view a divider assembly in accordance with a preferred embodiment of a present invention in an expanded state.
Figure 7:
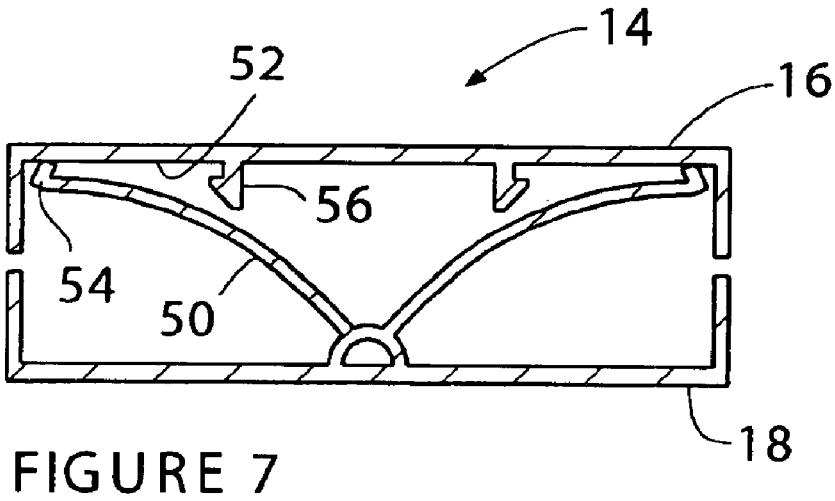
FIG. 7 is a section view the divider assembly illustrated in FIG. 6 in a compressed state.

Although the present inventions are not limited to any particular biasing device, the exemplary biasing device 48 illustrated in FIGS. 6 and 7 includes a pair of flexible arms 50 located within the divider assembly 14. One end of each arm 50 is secured to the bottom divider 18, while the other end (or "free end") of each arm slidably engages the inner surface 52 of the top divider 16. This arrangement may, of course, be reversed. The free ends of the arms 50 include hooks 54 that engage corresponding hooks 56 on the top divider inner surface 52 when the divider assembly 14 is in the expanded state illustrated in FIGS. 1 and 6. The hooks 54 and 56 prevent the divider assembly 14 from expanding beyond a predetermined distance and also prevent the top divider 16 and bottom divider 18 from separating from one another. As the divider assembly 14 is urged into the compressed state illustrated in FIGS. 2 and 7, the free ends of the flexible arms 50 slide away from the hooks 56 along the top divider inner surface 52. It should be noted that the hooks 54 and 56 may be omitted because keeping the top and bottom dividers 16 and 18 together is not a functional necessity and the failure to do so will not substantially affect the overall functionality of the dispenser 10.

The biasing device 48 may be integral with one of the dividers (as shown) or may be a separate element positioned within the divider assembly 14. A suitable biasing device may also consist of two or more resilient elements (as shown) or a single element. For example, an "S" or "Z"-shaped element (when viewed from the perspective shown in FIGS. 6 and 7) formed from a suitable material may be employed. Another example is resilient foam. The biasing device may also be a simple extrusion of resilient material that has a hollow shape in cross-section, such as a hollow ring, and that is compressed between the dividers 16 and 18. Other suitable biasing devices include, but are not limited to, helical springs, leaf springs, magnets aligned in polar opposition, and rubber structures. Regardless of configuration, the modulus of elasticity of the material used for the biasing device (e.g. plastic, metal or resilient foam) should be such that the biasing device will be flexible enough to distort to the compressed shape and also stiff enough to return to, or near, its original shape.

In addition to the aforementioned biasing function, the divider assembly 14 may be used to display indicia such as a brand name or advertising material. Referring again to FIG. 1, the top and bottom dividers 16 and 18 may be respectively provided with top (or "display") panels 58 and 60 on which such indicia may be displayed. The panels 58 and 60 also serve the cosmetic purpose of concealing the biasing device 48. Given that display panel 60 will only be displayed when a razor blade cartridge 24 has been removed and the divider assembly 14 is expanded, the indicia thereon could, if desired, display an image or text message. One exemplary message on the display panel 60 could be "Please return your cartridge to the dispenser after use." Other exemplary messages could include advertising material or a "You Won" message if the dispenser is being sold in conjunction with a game or promotion.

The exemplary dispenser 10 may also be provided with a tray extension 62 on which the user may rest a used razor blade cartridge 24 as the cartridge is being returned to the dispenser by way of the tension latches 38. The tray extension 62 will vertically align the cartridge with the retaining elements 20 and the latches 38 as well as protect the user from the cartridge blade(s).

With respect to materials, dispensers in accordance with the present inventions may be formed from any suitable material. Such materials include, but are not limited to, plastics (such as polystyrene, acrylic and ABS, metals (such as steel and aluminum) and combinations thereof. It should be noted, however, that the material for the portions of the dispensers that are resilient, such as the flexible arms 44 and the biasing device 48, should be selected accordingly.

The dimensions of dispensers in accordance with the present inventions will depend primarily on the type and number of objects to be dispensed. In exemplary implementation, the objects are razor blade cartridges which are about 0.330 inch×0.175 inch×1.557 inch, and five (5) cartridges are being stored. The divider assembly 14, when compressed, is about 0.520 inch×0.170 inch×1.557 inch. As such, the storage area within the tray 12 will be about 2.20 inch×0.180 inch×1.562 inch and the open region 32 will be about 0.310 inch×1.562 inch.

The exemplary dispensing device 10 may be used in the manner illustrated in FIGS. 8–12. The dispensing device 10 in the illustrated example initially stores the maximum number of unused razor blade cartridges 24 and, accordingly, the divider assembly 14 is initially compressed against the tension latches 38. This may be accomplished by inserting each of the unused razor blade cartridges 24 into the tray 12 by way of the tension latches 38 and then inserting the divider assembly 14 through the tension latches. The first unused razor blade cartridge 24*a* may be removed by first inserting the handle 34 though the open region 32 in the tray 12 in such a manner that the handle engages the cartridge in conventional fashion. [See FIG. 8.] The handle 34 may then be pivoted in the direction of arrow A in order to urge the razor blade cartridge 24*a* past the retaining devices 36 and out of the tray via the open region 32. Removal of the first unused razor blade cartridge 24*a* will allow the divider assembly 14 to assume its expanded state (FIG. 9), thereby urging the second unused razor blade cartridge 24*b* into alignment with the open region 32 and engagement with the retaining device 36. At this point, because the divider assembly 14 is extended and still against the tension latches 38, the user will be able to determine that the first unused razor blade cartridge has been removed from the dispensing device.

The razor blade cartridge 24*a* may be safely disposed of after use by simply reinserting it into the tray 12 through the tension latches 38. More specifically, and referring to FIG. 10, the razor blade cartridge 24*a* may placed on the tray extension 62 and then pushed in the direction of arrow B. The lateral edges of the razor blade cartridge 24*a* will engage the cam surfaces 42 of the tension latches 38, thereby causing the arms 44 to flex outwardly. Once the razor blade cartridge 24*a* has passed the cam surfaces 42, the arms 44 will flex back inwardly and bring the engaging surfaces 40 into contact with the cartridge, which locks the cartridge within the dispenser 10. [See FIG. 11.] At this point, because the divider assembly 14 is compressed and there is a single razor blade cartridge between the divider assembly and the tension latches 38, the user will be able to determine that one razor blade cartridge has been used and returned to the dispenser 10 and that four unused cartridges remain. The user will also be able to readily identify which one of the razor blade cartridges has been used because only used cartridges are located between the divider assembly 14 and the tension latches 38. Moreover, even if a user was unaware of the manner in which the present dispenser 10 is intended to be used, such a user would nevertheless be unable to obtain a used razor blade cartridge because the cartridges are only obtainable through the open region 32.

Figure 11:
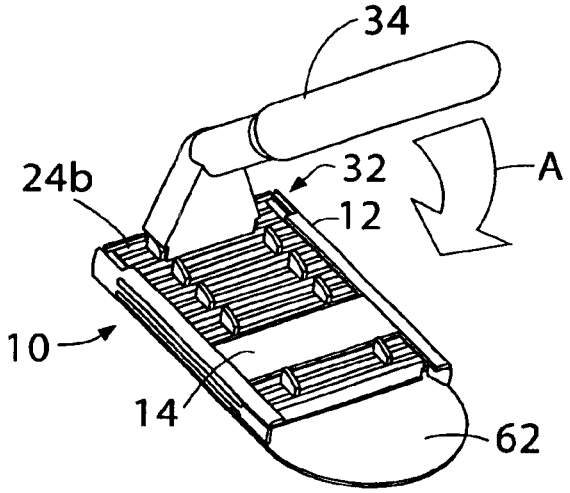
FIG. 11 is a perspective view of the dispenser illustrated in FIG. 1 showing the second object being removed.
Figure 12:
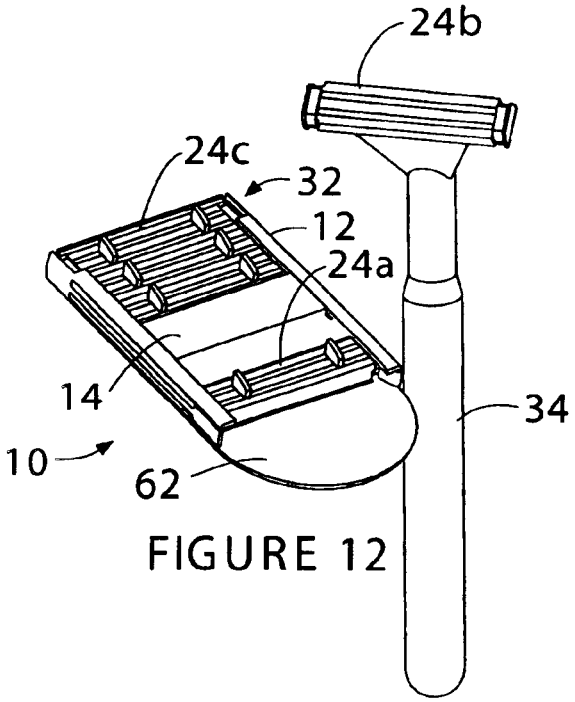
FIG. 12 is a perspective view of the dispenser illustrated in FIG. 1 with the first object returned and the second object removed.

The above-described process will be repeated a number of times. For example, as illustrated in FIG. 11, the second unused razor blade cartridge 24*b* (which is now aligned with the open region 32) may be engaged by the handle 34 in conventional fashion and removed from the dispenser 10 by pivoting the handle in the direction of arrow A. This will again allow the divider assembly 14 to assume its expanded state (FIG. 12), thereby urging the third unused razor blade cartridge 24*c* into alignment with the open region 32 and engagement with the retaining device 36, as well as maintaining the used razor blade cartridge 24*a* against the tension latches 38. After being used, the razor blade cartridge 24*b* may be reinserted into the tray 12 through the tension latches 38. At this point, because the divider assembly 14 is compressed and there are two razor blade cartridges between the divider assembly and the tension latches 38, the user will be able to determine that two razor blade cartridges have been used and returned to the dispensing device and that three unused cartridges remain.

This above-described process will continue until all of the razor blade cartridges 24 have been used and returned to the dispenser 10. Once this occurs, the divider assembly 14 will be aligned with the open region 32 and the user will be unable to remove the used razor blade cartridges. The dispenser 10 can then be safely disposed. The divider assembly 14 is preferably configured such that, even when compressed, it cannot be pulled through the open region 32. Nevertheless, there may be some instances where it is desirable to remove the used devices stored in the dispenser 10. Here, the divider assembly 14 may be configured so that it may be removed through the open region 32. One such instance is the removal of used drill bits from the dispenser 10, which may then be refurbished and returned to the dispenser along with the divider assembly 14 by way of the tension latches 38.

Figure 13:
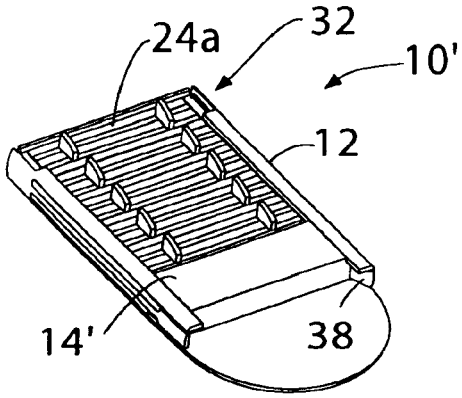
FIG. 13 is a perspective view of a dispenser in accordance with a preferred embodiment of a present invention filled with a plurality of unused objects.
Figure 14:
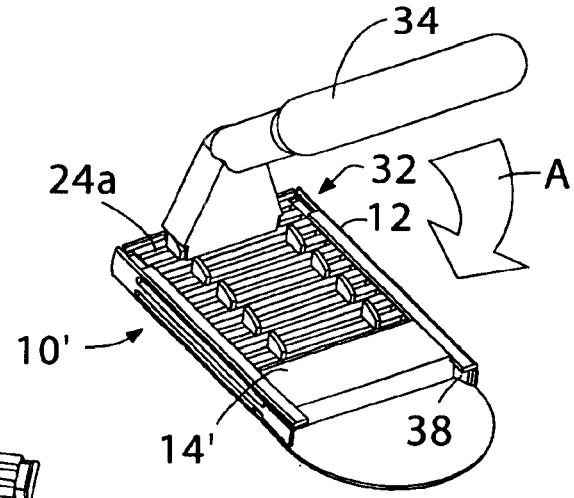
FIG. 14 is a perspective view of the dispenser illustrated in FIG. 13 showing the first object being removed.
Figure 15:
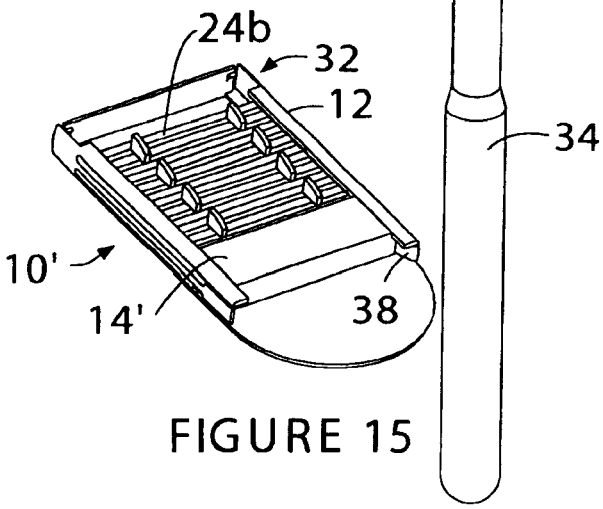
FIG. 15 is a perspective view of the dispenser illustrated in FIG. 13 with the first object removed.

Another exemplary dispenser in accordance with the present invention is generally represented by reference numeral 10' in FIGS. 13–18. Dispenser 10' is substantially similar to dispenser 10 and similar reference numerals are used to represent similar elements. Here, however, the dispenser 10' is provided with a divider 14' that is not expandable and compressible. Instead, it simply occupies a place in the tray 12 in order to separate the used and unused razor blade cartridges 24. Referring more specifically to FIG. 13, the dispensing device 10' initially stores the maximum number of unused razor blade cartridges 24 and, accordingly, the divider assembly 14' is initially against the tension latches 38. The handle 34 may be inserted though the open region 32 in the tray 12 so that the first unused razor blade cartridge 24*a* may be engaged by the handle and removed by pivoting the handle in the direction of arrow A, as shown in FIG. 14. Turning to FIG. 15, because the divider assembly 14' does not expand, the second unused razor blade cartridge 24*b* will simply remain in its initial position.

Figure 16:
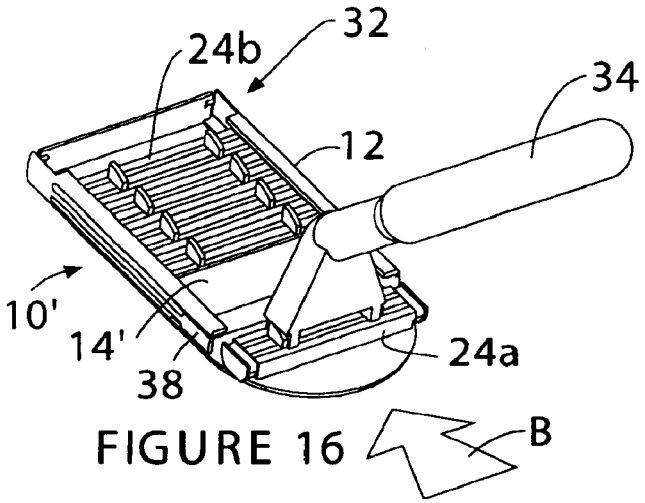
FIG. 16 is a perspective view of the dispenser illustrated in FIG. 13 showing the first object being returned to the dispenser.
Figure 17:
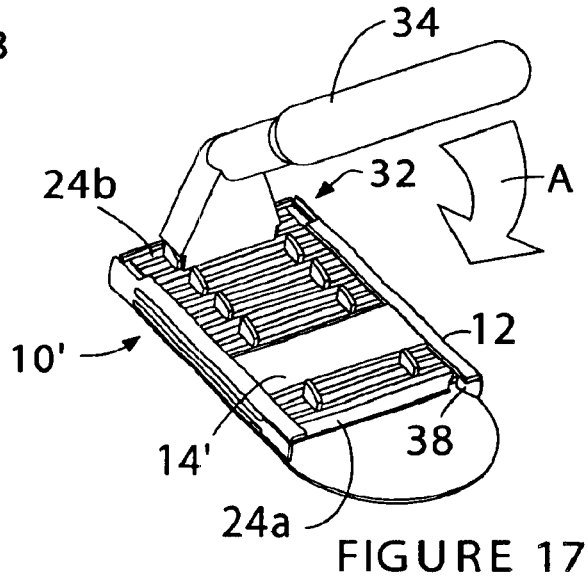
FIG. 17 is a perspective view of the dispenser illustrated in FIG. 13 showing the second object being removed.
Figure 18:
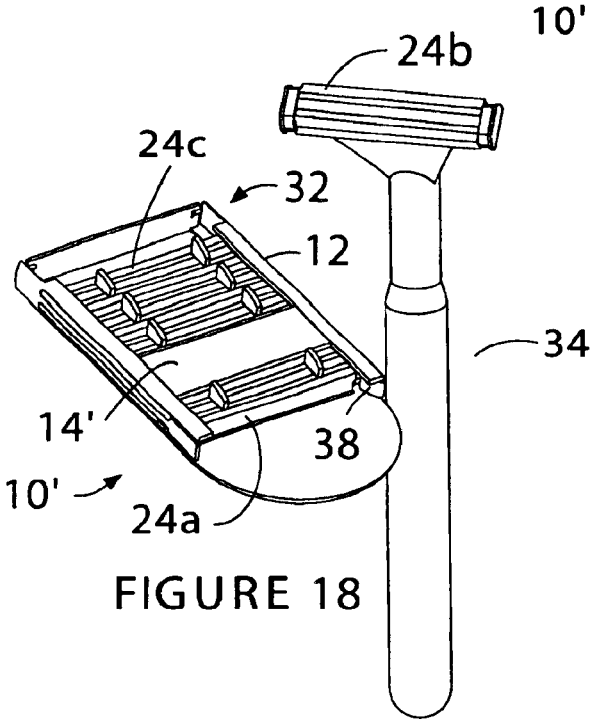
FIG. 18 is a perspective view of the dispenser illustrated in FIG. 13 with the first object returned and the second object removed.

The razor blade cartridge 24*a* may be safely disposed of by reinserting it into the dispenser 10' through the tension latches 38 in the manner illustrated in FIG. 16. As noted above, the latches 38 will also lock the used razor blade cartridge 24*a* within the dispenser 10'. [See FIG. 17.] At this point, because there is a single razor blade cartridge between the divider assembly 14' and the tension latches 38, the user will be able to determine that one razor blade cartridge has been used and returned to the dispensing device 10', which cartridge it is, and how many unused cartridges are remaining. Returning the used razor blade cartridge 24*a* to the dispenser 10' will also push the second unused razor blade cartridge 24*b* into alignment with the open region 32. The second unused razor blade cartridge 24*b* may then be engaged by the handle 34 in conventional fashion and removed from the dispenser 10' by pivoting the handle in the direction of arrow A. Because the divider assembly 14' does not expand, the third unused razor blade cartridge 24*c* will not move into alignment with the open region 32 until the razor blade cartridge 24*b* is returned to the dispenser 10'. [See FIG. 18.] As such, the next step in the process is the return of the second razor blade cartridge 24*b* to the dispenser 10', which pushes the third razor blade cartridge 24*c* into alignment with the open region 32.

This above-described process will continue until all of the razor blade cartridges 24 have been used and returned to the dispenser 10'. The divider assembly 14' will then be aligned with the open region 32 and the user will be unable to remove the used razor blade cartridges. The dispenser 10' can then be safely disposed of.

Although the present inventions have been described in terms of the preferred embodiments above, numerous modifications and/or additions to the above-described preferred embodiments would be readily apparent to one skilled in the art.

By way of example, but not limitation, in those instances where dispensers in accordance with the present inventions are sold with the consumable objects already stored therein, such as could be the case for the exemplary dispenser 10 and razor blade cartridges 24, the dispenser could be sold with the tray filled to capacity (see FIGS. 2 and 13) as described above or with one object missing (see FIGS. 9 and 15). Providing a tray with one object missing allows the purchaser to dispose of a used object, such as a used razor blade cartridge, that he or she is already in possession of. Additionally, all or a portion of the longitudinal axis of the dispenser could be curved.

It is intended that the scope of the present inventions extends to all such modifications and/or additions.

I claim:

1. A method of displaying a message to a user of a dispenser including an outlet, the method comprising the steps of:

positioning a plurality of objects within the dispenser; and positioning an assembly that is movable between a compressed state and an expanded state within the dispenser such that the assembly is visible to the user, is in the compressed state and will move to the expanded state when one of the objects is removed from the outlet, the assembly having a surface that carries the message that is only visible when the assembly is in the expanded state.

2. A method as claimed in claim 1, wherein the step of positioning a plurality of objects within the dispenser comprises positioning a plurality of razor blade cartridges within the dispenser.

3. An apparatus, comprising:

a tray defining a storage area having a longitudinal axis, an inlet and an outlet;

a plurality of objects located within the storage area and movable along the longitudinal axis; and means, movable between user visible locations within the storage area, for expanding from a compressed state to an expanded state and displaying a message that is only visible in the expanded state.

4. An apparatus as claimed in claim 3, wherein plurality of objects comprises a plurality of razor blade cartridges.

* * * * *